US006182769B1

(12) United States Patent
Karlén

(10) Patent No.: US 6,182,769 B1
(45) Date of Patent: Feb. 6, 2001

(54) DEMINING DEVICE INCLUDING DEMINING DISCS AND IMPACT DEVICES AND DEMINING METHOD UTILIZING THE DEVICE

(75) Inventor: Anders Karlén, Karlstad (SE)

(73) Assignee: Bofors AB, Karlskoga (SE)

( * ) Notice: Under 35 U.S.C. 154(b), the term of this patent shall be extended for 0 days.

(21) Appl. No.: 09/445,106

(22) PCT Filed: Jun. 15, 1998

(86) PCT No.: PCT/SE98/01149

§ 371 Date: Feb. 3, 2000

§ 102(e) Date: Feb. 3, 2000

(87) PCT Pub. No.: WO98/58223

PCT Pub. Date: Dec. 23, 1998

(30) Foreign Application Priority Data

Jun. 16, 1997 (SE) ..... 9702281

(51) Int. Cl.[7] ..... F41H 11/12; F41H 11/16

(52) U.S. Cl. ..... 172/122; 172/123; 172/810; 172/548; 89/1.13

(58) Field of Search ..... 172/548, 122, 172/123, 810, 518, 540; 89/1.13

(56) References Cited

U.S. PATENT DOCUMENTS 5,442,990 8/1995 Krohn ..... 172/122 X

FOREIGN PATENT DOCUMENTS

| | | |
|---|---|---|
| 2632568 | 1/1978 | (DE) . |
| 3127856 | 2/1983 | (DE) . |
| 4442135 | 1/1996 | (DE) . |
| 503 649 | 7/1996 | (SE) . |
| 95/24604 | 9/1995 | (WO) . |
| 97/38281 | 10/1997 | (WO) . |

*Primary Examiner*—Christopher J. Novosad
(74) *Attorney, Agent, or Firm*—Pollock, Vande Sande & Amernick, R.L.L.P.

(57) ABSTRACT

A method for increasing effectiveness of mine clearance when clearing landmines. A vehicle-mounted, mechanically driven, rotary cultivator type demining tool is provided. The demining tool includes a horizontal shaft, a demining unit rotating around the horizontal shaft, a plurality of parallel demining discs located at a distance from each other and rotating around the shaft which when the demining tool is in operation cut down into an upper ground layer to a pre-determined depth to cause mines in their path to detonate or to fragment into harmless fragments, and impact devices located between the demining discs for working the upper ground layer between the demining discs such that the impact devices impact with the upper ground layer between each pair of demining discs several times per rotation of the demining tool. An upper ground layer where mines may be deployed is worked with the demining tool.

23 Claims, 3 Drawing Sheets

DEMINING DEVICE INCLUDING DEMINING DISCS AND IMPACT DEVICES AND DEMINING METHOD UTILIZING THE DEVICE

FIELD OF THE INVENTION

The present invention relates to a method and a device for rapid clearance of landmines lying freely on the surface or buried in the upper ground layer, including both small anti-personnel (AP) mines and larger anti-vehicle and anti-tank mines.

BACKGROUND OF THE INVENTION

For rapid clearance of routes through minefields the military have previously used primarily chain flails and mine ploughs. Theses are most appropriate for military purposes and have achieved far from the 100% clearance result that is desirable in civil mine clearance operations after a conflict is over. Civil mine clearing operations have thus been achieved by the time consuming and labor intensive method of using probes or, perhaps, mainly by the use of electromagnetic mine detectors. The latter are, in fact, very sensitive but there are AP mines that do not contain any metal at all and are thus not detected. Moreover, the number of false indications that have to be checked is always high, especially in areas where battles have occurred as there is always a multitude of fragments in the ground in such areas.

In latter years, however, increasing interest has been focused on mechanical mine clearance vehicles that operate in a similar way to the mechanical rotary cultivator principle. They have been shown to have good capacity, and although they cannot operate in all types of terrain they clearly constitute a positive addition to the field of mine clearing.

Many of these rotary cultivator type demining tools are designed with horizontal rotation shafts fitted with multi-disc cultivators, each disc usually being fitted with individual teeth around its periphery.

The basic concept for the rotary cultivator disc type of mine clearing device is described in WO 95/24604, while DE 4.442.135 describes a variant of the same basic concept in which the various discs incorporate very large teeth machined direct in the actual disc and with apertures to reduce the risk of damage in the event of mine detonations in or under the demining tool.

The objective with demining tools that function on the rotary cultivator principle is that they shall 'chew' the mines in their path into small fragments or cause the mines to detonate. In practice it has been shown that usually mines are made to detonate in or under the demining tool which is usually no problem in the case of AP mines, but anti-vehicle and anti-tank mines easily cause damage to the demining tool. Consequently, it should be easy to repair or replace.

In practice, however, the main problem with demining tools of the above rotary cultivator type has not been damage to the demining tool by mine detonations initiated, but that individual mines—especially small AP mines—can pass undamaged through the demining tool. Quite simply, it has been difficult to achieve the virtual 100% mine clearance effect necessary in civil mine clearing. The cultivator discs cannot be located too densely as the closer they are to each other the higher the machine power that is needed.

SUMMARY OF THE INVENTION

The objective of the present invention is to raise the clearance percentage of demining tools of the above mentioned basic type.

As a demining tool of the above rotary disc roller type works, the upper ground layer down to a predetermined depth the soil worked collects between the cultivator discs and this accumulated soil sometimes includes undamaged individual mines.

We have now—significantly—found that mines embedded in this accumulated soil between the cultivator discs can be made to detonate if we mount a number of impact devices in the form of impact segments between the cultivator discs. These impact segments co-rotate with the shaft of the rotary cultivator discs and are arranged in a plane parallel with the cultivator discs with several impact segments in one and the same plane with a space between each impact segment so that as impact segments in the same plane follow each other (in rotation) they work the accumulated soil between the cultivator discs. The number of such impact devices in each plane may be 2–10, but preferably 5–10. In the preferred design they also have a leading edge relative to their direction of rotation that is bevelled rearwards in the direction of rotation of the roller such that the section of the impact segment closest to the axis of rotation first meets the accumulated soil between the cultivator discs and the leading edge of each impact segment has a sawtooth form.

The design of the leading edge of each impact segment and the space between each impact segment in the same rotational plane results in working of the accumulated soil between each two adjacent cultivator discs while the intermittent agitation of the accumulated soil by the impact devices acts to trigger all types of pressure sensitive AP mines.

Practical tests with live mines in completely realistic conditions have shown that by supplementing an otherwise equivalent demining tool with the impact devices claimed in the present invention, the mine clearance capability is increased from approximately 95% to 99%.

BRIEF DESCRIPTION OF THE DRAWINGS

The present invention shall now be described in more detail with reference to the appended figures:

FIG. 1 shows a perspective view of a demining vehicle, while

DETAILED DESCRIPTION OF THE INVENTION

Figure 1:
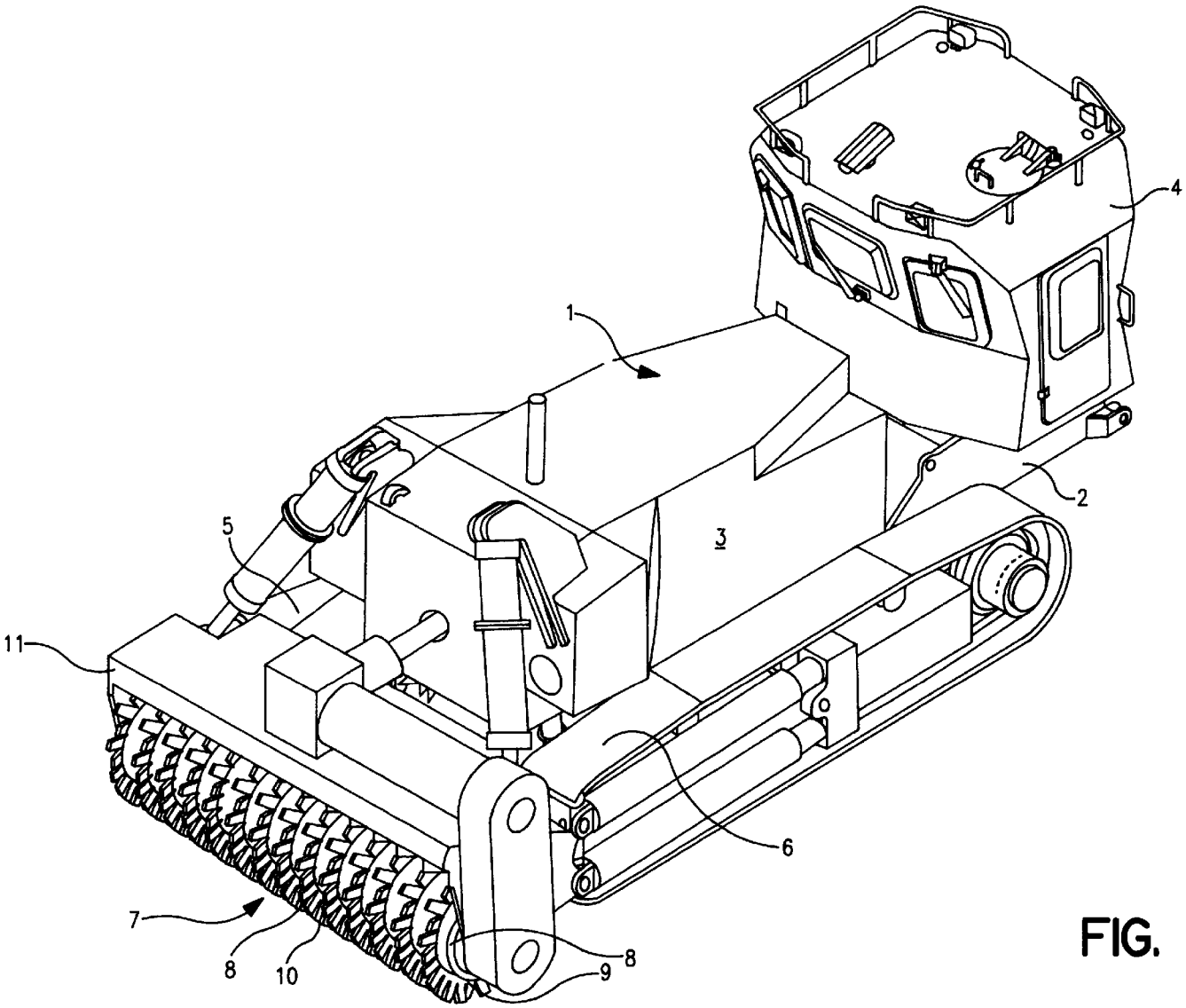

The main parts of the demining vehicle 1 illustrated in FIG. 1 are the chassis 2, the engine unit 3, control cab 4, drive tracks 5 and 6, and the actual demining tool 7. The latter comprises a roller-shaped shaft 8 fitted with a number of parallel demining discs 9, each of which is fitted with peripheral teeth 10 made of a hard material to minimise wear round the periphery of the demining discs 9. The demining tool 7 is journalled to enable rotation in an inverted cradle 11 which in turn can be raised or lowered to enable different operating depths in the upper ground layer. The engine 3 is used to drive both the demining vehicle 1 and to rotate the demining tool 7. The demining tool 7 illustrated in FIG. 1 is of a more general nature and is not designed in accordance with the present invention.

Figure 2:
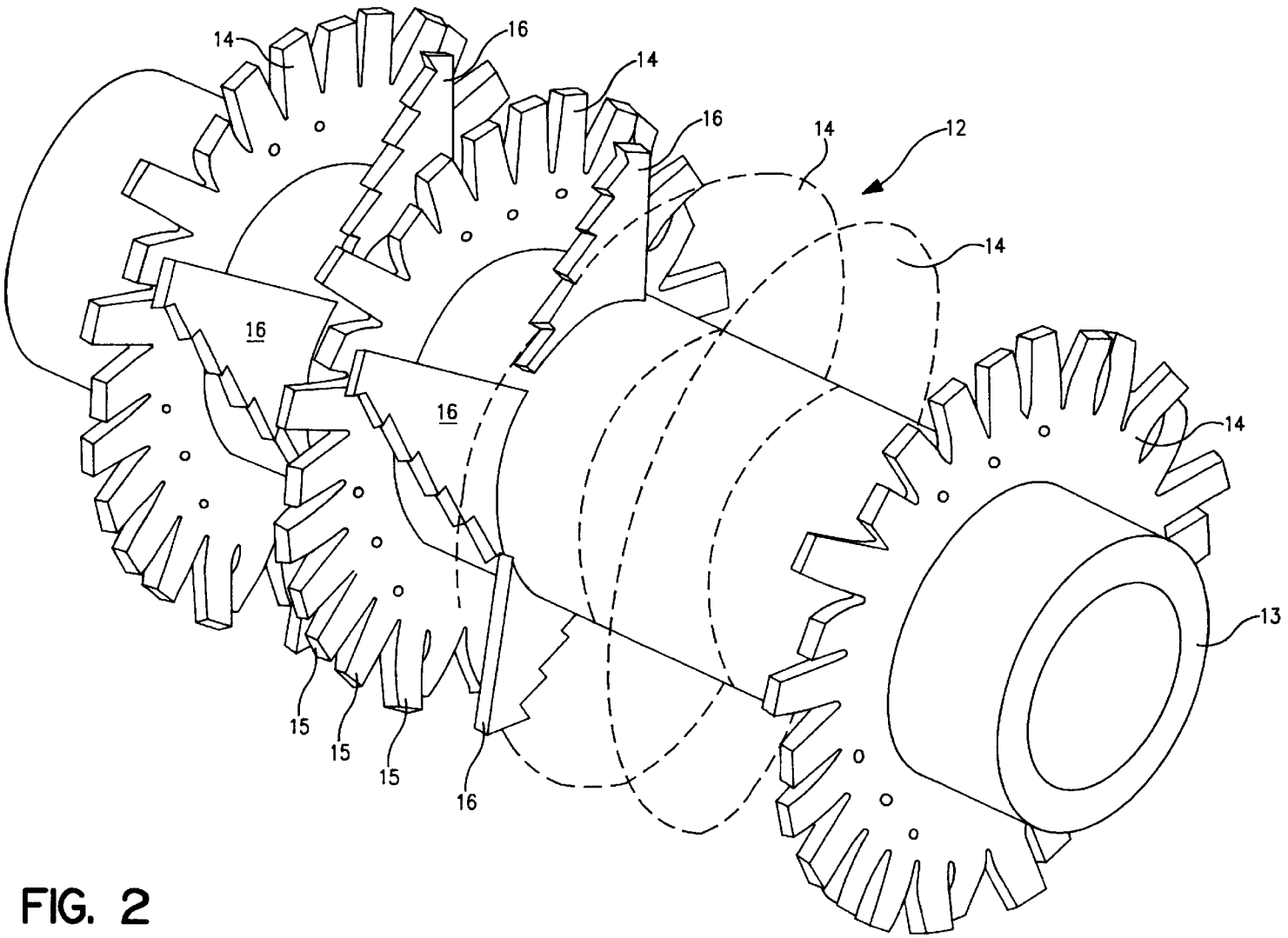
FIG. 2 shows the design principle of the demining tool.

The demining tool 12 in FIG. 2 is shown in more detail to illustrate the design as claimed in the present invention.

It consists of a central tubular roller shaft 13, a number of demining discs 14. Although only a few discs are illustrated in the figure, each one incorporates a number of fingers around its periphery and generally designated 15. Each finger is free on three faces (around the axis of rotation). Also each finger can be fitted with a tooth holder of the type vaguely indicated on FIG. 1. The tooth holder can in turn be fitted with a tooth made of hard material. To provide these demining discs 14 with the optimal operating characteristics, the fingers at the periphery are angled outwards in opposite directions and at varying angles from the main plane of the demining discs so that they form a zigzag pattern around the demining discs. The actual angles cannot be specified generally but must be tested and tried.

Figure 3:
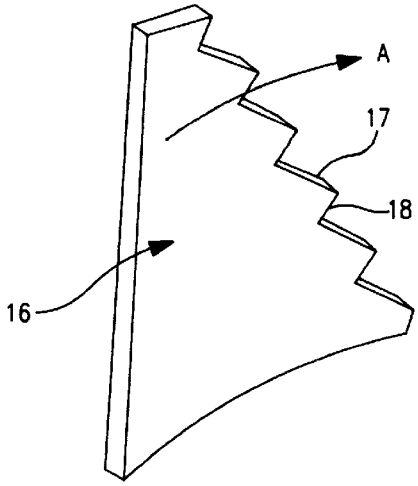
FIG. 3 shows a detailed illustration of one of the impact devices as claimed in the present invention.

The impact devices 16 as claimed in the present invention, the design of which is shown in more detail in FIG. 3, are mounted between each two adjacent demining discs 14. The impact devices 16 are mounted between the demining discs 14 with a certain distance between them.

The number of impact devices at each station on the roller, i.e. within each space between two adjacent demining discs, is 2–10 and preferably 5–10. They can be mutually aligned or be slightly displaced laterally in relation to each other. Between each two impact devices there is always a large or small space. The impact devices 16 incorporate an oblique—relative to the main direction of operation of the demining tool 12—leading edge which, one-after-one, strike the accumulated soil that they are designed to demine further and further outwards from the rotational axis of the demining tool 12. The main direction of operation is designated A on FIGS. 3 and 5. To enhance their effectiveness each impact device also has a sawtooth shaped leading edge as illustrated in the figures. Each sawtooth comprises a longitudinal edge 17, which only slightly deviates from the main direction of the leading edge of the impact device 16, and a short lateral edge 18 that cuts mainly right through the main direction of the leading edge of the impact device 16.

In the general type of demining tool 12 illustrated in FIG. 2 with a central roller it is desirable to restrict the number of welded joints to a minimum. However, it is difficult to avoid welding the demining discs to the roller. On the other hand, it is possible to attach the impact devices mechanically.

Figure 4:
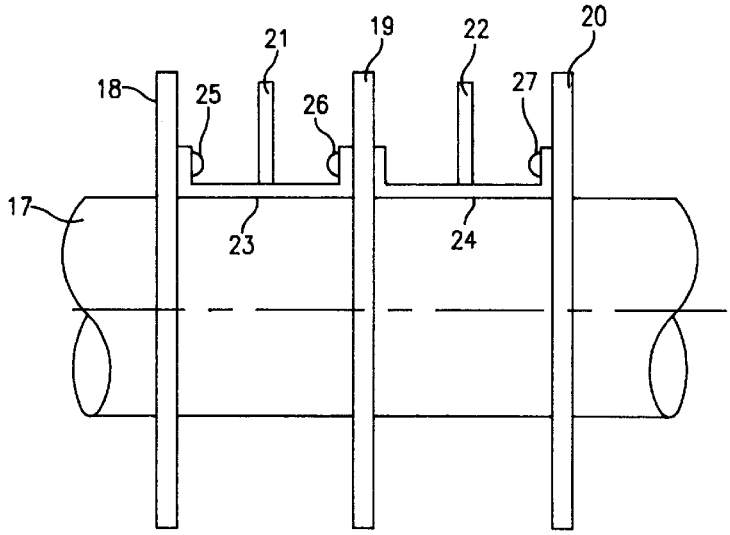
FIGS. 4 & 5 show different mechanical attachments for the impact devices.

FIG. 4 illustrates part of a longitudinal projection of a demining tool of the type as claimed in the present invention in which 17 denotes the roller shaft, 18, 19 and 20 denote the demining discs, and 21 and 22 signify two impact devices. The latter are welded onto holders 23 and 24 which are in turn attached to each side of the demining discs by bolts 25–27.

Figure 5:
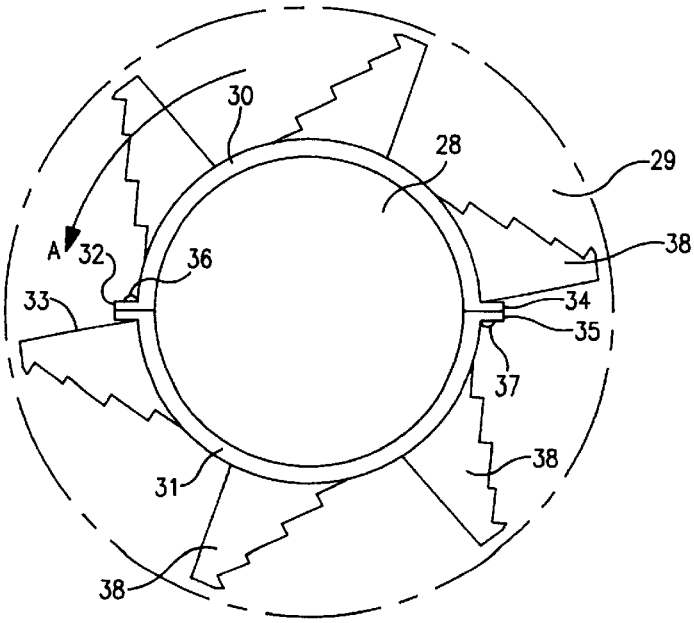

Another variant of mechanical attachment of the impact devices is shown in FIG. 5 in the form of a cross-section through a demining tool illustrating the central roller shaft 28, a demining disc 29, and two semi-circular attachment devices 30 and 31 with lugs 32–35 assembled and held together by bolts 36 and 37, and showing some of the impact devices 38 welded to each of the attachment devices 30, 31.

What is claimed is:

1. A method for increasing effectiveness of mine clearance when clearing landmines, comprising:

providing a vehicle-mounted, mechanically driven, rotary cultivator type demining tool comprising a horizontal shaft, a demining unit rotating around the horizontal shaft, a plurality of parallel demining discs located at a distance from each other and rotating around the shaft which when the demining tool is in operation cut down into an upper ground layer to a pre-determined depth to cause mines in their path to detonate or to fragment into harmless fragments, and impact devices located between the demining discs for working the upper ground layer between the demining discs such that the impact devices impact with the upper ground layer between each pair of demining discs several times per rotation of the demining tool; and working an upper ground layer where mines may be deployed with the demining tool.

2. The method according to claim 1, further comprising:

providing the demining discs with circular toothed outer peripheries.

3. A vehicle-mounted demining tool for clearing landmines by working an upper ground layer where mines may be deployed, the device comprising:

a horizontal roller shaft;

a plurality of parallel demining discs arranged on the roller shaft a distance front each other and rotating with the roller shaft and which as the demining tool operates cut down into the upper ground layer to a pre-determined depth to cause mines in their path to detonate or to be fragmented into harmless fragments; and radially projecting impact devices arranged on the roller shaft in spaces between each two adjacent demining discs, the impact devices working the upper ground layer between the demining discs.

4. The device according to claim 3, wherein the impact devices rotate several times per rotation of the demining tool.

5. The device according to claim 3, wherein the demining discs comprise circular toothed outer peripheries.

6. The device according to claim 3, wherein the impact devices are fixed.

7. The device according to claim 3, wherein the device operates as a rotary cultivator.

8. The device according to claim 3, wherein each impact device comprises an oblique leading edge in a direction of impact relative to the upper ground layer with which it impacts such that a section of the impact device closest to an axis of rotating of the demining tool impacts with the upper ground layer first.

9. The device according to claim 8, wherein the oblique edge comprises sawtoothed notches.

10. The device according to claim 9, wherein each of the sawtoothed notches comprises an elongated longitudinal edge in a main direction of the oblique edge and a short lateral edge substantially at a right angle to the longitudinal edge.

11. The device according to claim 3, wherein the number of impact devices between each pair of demining discs is 2–10.

12. The device according to claim 11, wherein there is a free space between each adjacent impact devices in the same radial plane.

13. The device according to claim 3, wherein the number of impact devices between each pair of demining discs is 5–10.

14. The device according to claim 13, wherein there is a free space between each adjacent impact devices in the same radical plane.

15. The device according to claim 3, further comprising:

holders for attaching the impact devices to the demining discs located on either side of impact devices.

16. The device according to claim 3, further comprising:

holders attached in or around the roller shaft for attaching the impact devices.

17. The device according to claim 3, wherein the demining discs mounted on the roller shaft by welding.

18. The device according to claim 3, wherein each demining disc comprises a plurality of fingers arranged about a periphery of each demining disc, each finger comprising three free faces.

19. The device according to claim 18, further comprising:

at least one tooth holder on each finger, each tooth holder incorporating a tooth made of hard material.

20. The device according to claim 18, wherein the fingers are cut out of the demining discs.

21. The device according to claim 18, wherein each finger is angled out relative to a main plane of the demining disc.

22. The device according to claim 21, wherein each finger is angled out at opposite angle from an adjacent finger.

23. The device according to claim 18, wherein each finger is fitted with a tooth constructed of a hard material.

* * * * *